United States Patent [19]

Fay

[11] Patent Number: 4,961,273

[45] Date of Patent: Oct. 9, 1990

[54] METHOD AND MEANS FOR ASSURING FREEZE DRYER CHAMBER STERILITY

[75] Inventor: John M. Fay, Warminster, Pa.

[73] Assignee: Hull Corporation, Hatboro, Pa.

[21] Appl. No.: 190,711

[22] Filed: May 6, 1988

Related U.S. Application Data

[63] Continuation-in-part of Ser. No. 31/638, Mar. 30, 1987, abandoned.

[51] Int. Cl.[5] ..... F26B 19/00

[52] U.S. Cl. ..... 34/92; 74/18.2; 403/50; 414/8

[58] Field of Search ..... 34/5, 92, 242; 414/8; 403/50, 51; 74/18.2

[56] References Cited

U.S. PATENT DOCUMENTS

| | | | |
|---|---|---|---|
| 1,452,431 | 4/1923 | Milkie | 74/18.2 X |
| 2,395,843 | 3/1946 | Brown | 74/18.2 X |
| 2,649,011 | 8/1953 | Black | 74/18.2 X |
| 2,875,621 | 3/1959 | Peters | 74/18.2 |
| 4,474,518 | 10/1984 | Critchley et al. | 414/8 |
| 4,506,455 | 3/1985 | Rossi | 34/5 |

FOREIGN PATENT DOCUMENTS

| | | | |
|---|---|---|---|
| 2556467 | 6/1977 | Fed. Rep. of Germany | 422/26 |
| 2758677 | 7/1979 | Fed. Rep. of Germany | 74/18.2 |

*Primary Examiner*—William E. Wayner

*Attorney, Agent, or Firm*—Olson & Olson

[57] ABSTRACT

The shelf-operating piston rod of an hydraulic cylinder of a freeze dryer is prevented from possibly contaminiating the freeze dryer chamber either by isolating the piston rod from the chamber by enclosing the piston rod within the chamber with an impervious flexible sleeve capable of extending and retracting with the piston rod. The pressure within the sleeve may be adjusted to approach or match the pressure within the freeze dryer chamber. Prevention of contamination alternatively may be achieved by interposing a sterilizing container between the external hydraulic cylinder and the freeze dryer and surrounding the piston rod, and subjecting the piston rod within the sterilizing container to sterilizing fluid before the piston rod is extended into the freeze dryer chamber. In one embodiment the sterilizing container is substantially the same length as the length of piston rod required to enter the freeze dryer chamber, whereby said length of piston rod may be fully retracted from the freezer dryer chamber and its full length sterilized in the sterilizing container. In a second embodiment the sterilizing container is substantially shorter than the length of piston rod required to be extended into the freeze dryer chamber, and the piston rod is sterilized progressively in the sterilizing container as it moves therethrough into the freeze dryer chamber.

7 Claims, 2 Drawing Sheets

METHOD AND MEANS FOR ASSURING FREEZE DRYER CHAMBER STERILITY

CROSS-REFERENCE TO RELATED APPLICATION

This is a continuation-in-part of my co-pending application, Ser. No. 31,638 filed 30 March 1987, now abandoned.

BACKGROUND OF THE INVENTION

This invention relates to freeze dryers, and more particularly to method and means for preventing possible contamination of a freeze dryer chamber and the freeze dried product by the operating cylinder rod.

Freeze drying equipment includes a chamber in which a plurality of spaced apart shelves supporting vials or other containers to be stoppered, are moved toward and away from each other by operation of an elongated piston rod which is connected at its inner end to a header within the freeze drying chamber and at its outer end to a piston which is reciprocative in an elongated hydraulic cylinder mounted outside the freeze drying chamber.

It has long been suggested, without practicable solution, that contamination may be introduced into the freeze drying chamber by the piston rod. The only known effort to eliminate this possibility is disclosed in U.S. Pat. No. 3,286,366 in which it is proposed to replace the cylinder and piston rod with a sealed, expandable air bellows or bladder contained within the freeze drying chamber. Although this arrangement may be effective for a small, single shelf freeze dryer, as is disclosed in the patent, it is not operable for the large, multiple shelf freeze dryer systems with which the present invention is concerned, since the pressures and movement distances involved require the use of rather long hydraulic cylinders and piston rods operated at substantially greater pressures than are available with air bellows.

SUMMARY OF THE INVENTION

In accordance with this invention, the shelf-operating piston rod of an hydraulic cylinder of a freeze dryer is either isolated from the freeze dryer chamber by an impervious enclosing flexible sleeve as the piston rod reciprocates within the chamber, or the piston rod is sterilized prior to entering the chamber.

It is the principal objective of this invention to provide method and means for preventing the shelf-operating piston rod of an hydraulic cylinder of a freeze dryer from possibly contaminating the freeze drying chamber and its contents.

Another objective of this invention is the provision of the foregoing method and means which are characterized by simplicity and economy of structure and mode of operation.

The foregoing and other objectives and advantages of this invention will appear from the following detailed description, taken in connection with the accompanying drawings of preferred embodiments.

DESCRIPTION OF THE PREFERRED EMBODIMENTS

Figure 1:
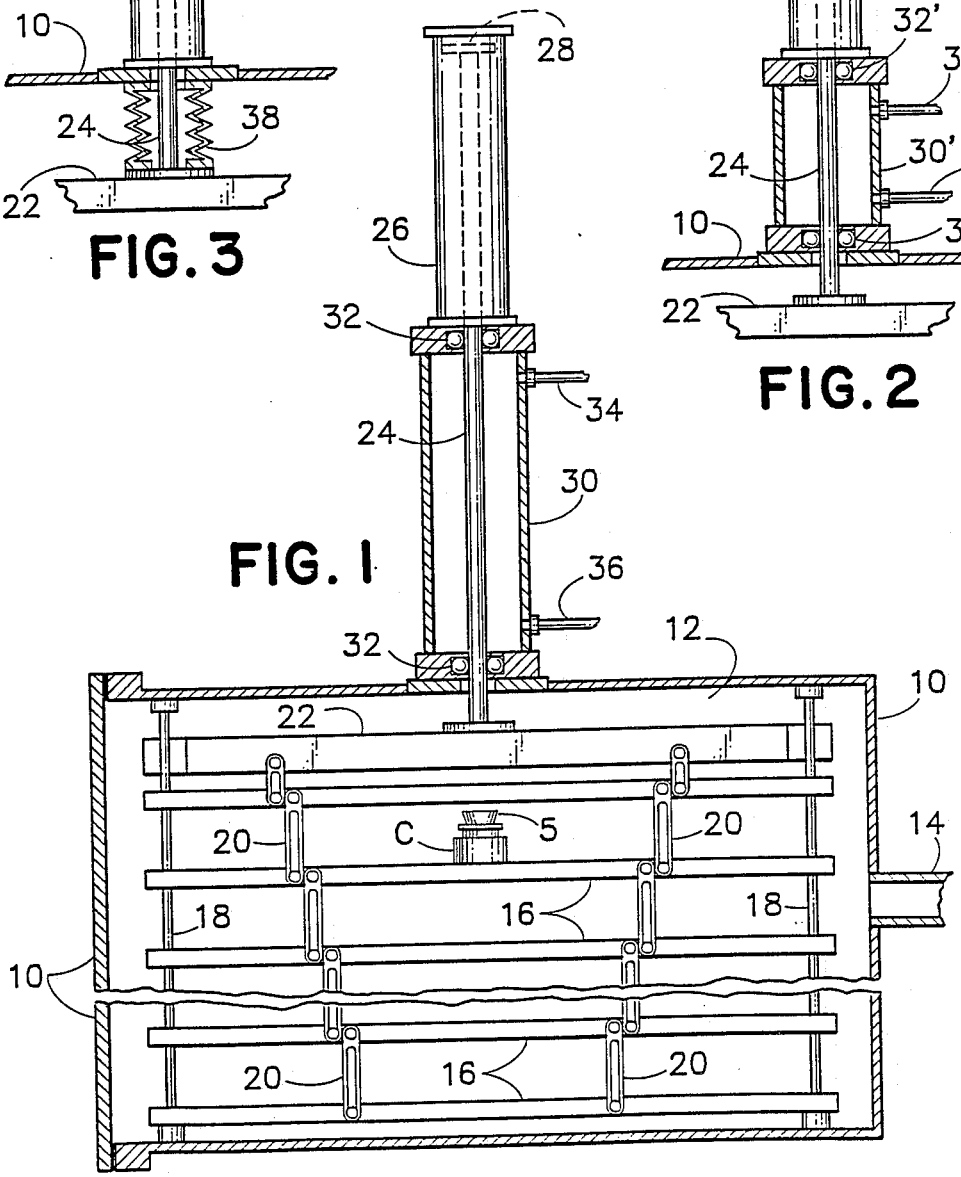
FIG. 1 is a foreshortened vertical section through a freeze dryer illustrating one embodiment of the method and means of this invention.

Referring first to FIG. 1 of the drawings, there is shown for purpose of illustration a freeze dryer housing 10 defining an internal chamber 12 capable of being provided with an evacuated or inert atmosphere by connecting a source of vacuum or a source of inert gas to inlet 14. A plurality of shelves 16 are provided with corner openings through which vertical corner guide rods 18 are received for guiding the shelves in vertical movement relative to each other. Each shelf is supported from the shelf above it by means of hangers 20. The uppermost shelf is suspended from a header 22 to which is secured the inner end of an elongated piston rod 24. The piston rod extends upwardly through the top wall of the freeze dryer housing 10 and into an elongated hydraulic cylinder 26 where it is connected at its upper end to an operating piston 28.

The freeze dryer illustrated is of the downwardly closing type since the cylinder 26 is on top of the housing. It will be understood that this invention is also applicable to freeze dryers of the upwardly closing type wherein the cylinder is at the bottom of the housing, and also to freeze dryers provided with cylinders at both ends of the housing, as in U.S. Patent Re. 28,085.

In the embodiment illustrated in FIG. 1, the hydraulic cylinder 26 is spaced upwardly from the top wall of the freeze dryer housing by means of a hollow sterilizing cylinder 30 through which the piston rod 24 extends. Annular seals 32 in the upper and lower heads of the sterilizing cylinder seal the interior of the sterilizing cylinder against contamination from the outside.

The sterilizing cylinder 30 is arranged to receive a fluid sterilizing medium, such as ethylene oxide, hydrogen peroxide, steam, or other suitable sterilizer. For this purpose the sterilizing cylinder is provided with an inlet 34 and an outlet 36 for the circulation of sterilizing fluid through the cylinder.

It is to be noted in FIG. 1 that the length of the sterilizing cylinder 30 is substantially equal to the length of the piston rod 24 required to move the shelves 16 downwardly to fully closed position. Accordingly, when the piston rod is in the fully retracted position of FIG. 1, with the shelves 16 fully extended one from another, as for loading the shelves with containers C carrying loosely fitted stoppers S, sterilizing fluid may be introduced through the inlet 34 and exhausted through the outlet 36 to completely sterilize the full operating length of the piston rod. Thereafter, hydraulic fluid under pressure may be supplied to the top end of the hydraulic cylinder 26 to drive the piston 29 and its piston rod 24 downward to effect the closing operation of the shelves 16. During this closing movement of the shelves, the length of piston rod extended into the freeze dryer chamber 12 is completely sterilized so that no contamination may be introduced into the freeze dryer chamber and its contents.

Figure 2:
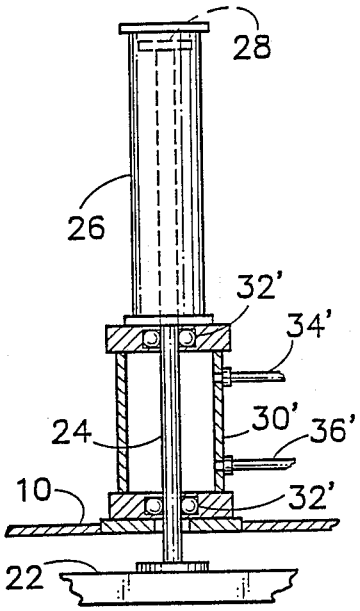
FIG. 2 is a fragmentary vertical section similar to FIG. 1 illustrating a second embodiment of the method and means of this invention.

The embodiment illustrated in FIG. 2 differs from the embodiment of FIG. 1 only in the length of the sterilizing cylinder. In FIG. 2 the length of the sterilizing cylinder 30' is substantially less than the full operating length of the piston rod 24. Thus, when the piston rod is fully retracted from the freeze dryer chamber 12, with the shelves 16 fully extended one from another, only a portion of the length of the piston rod 24 extends through the shortened sterilizing cylinder 30'.

In the operation of the embodiment of FIG. 2, the sterilizing fluid is introduced into the sterilizing cylinder 30' through the inlet 34' and exhausted through the outlet 36' continuously while the piston rod 24 is driven downward from the hydraulic cylinder 26, to effect the closing of the shelves 16. During the downward movement of the piston rod, the portion moving through the sterilizing cylinder 30' is sterilized before it enters the freeze dryer chamber 12.

When the shelf closing operation has been completed, with the piston rod 24 fully extended into the freeze dryer chamber 12, it will be understood that the full length of the piston rod within the freeze dryer chamber will have been sterilized, as in the embodiment of FIG. 1.

Figure 3:
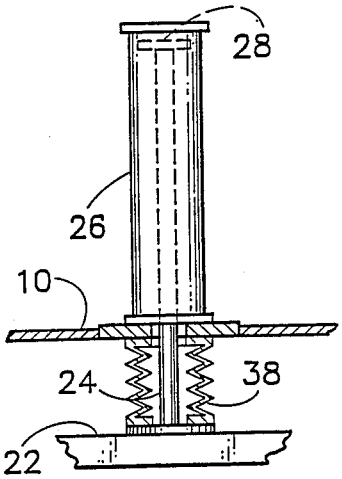
FIG. 3 is a fragmentary vertical section similar to FIG. 2 illustrating a third embodiment of the method and means of this invention.

The embodiment of FIG. 3 differs from the embodiments of FIGS. 1 and 2 in the substitution for the external sterilizing cylinders 30 and 30' of an internal flexible or elastic sleeve 38 which surrounds the piston rod 24 throughout its movement within the freeze dryer chamber 12. Thus, the inner end of the sleeve 36 is sealed to the header 22, and hence to the inner end of the piston rod 24, and its outer end is sealed to the inner side of the top wall of the freeze dryer housing 10.

When the hydraulic cylinder 26 is operated to extend the piston rod 24 into the freeze dryer chamber 12 during the closing operation of the shelves 16, the impervious sleeve 38 extends to maintain the full length of the piston rod within the chamber 12 isolated from the latter. As the piston rod is retracted into the hydraulic cylinder 26 during the opening movements of the shelves, the impervious sleeve contracts correspondingly.

Figure 4:
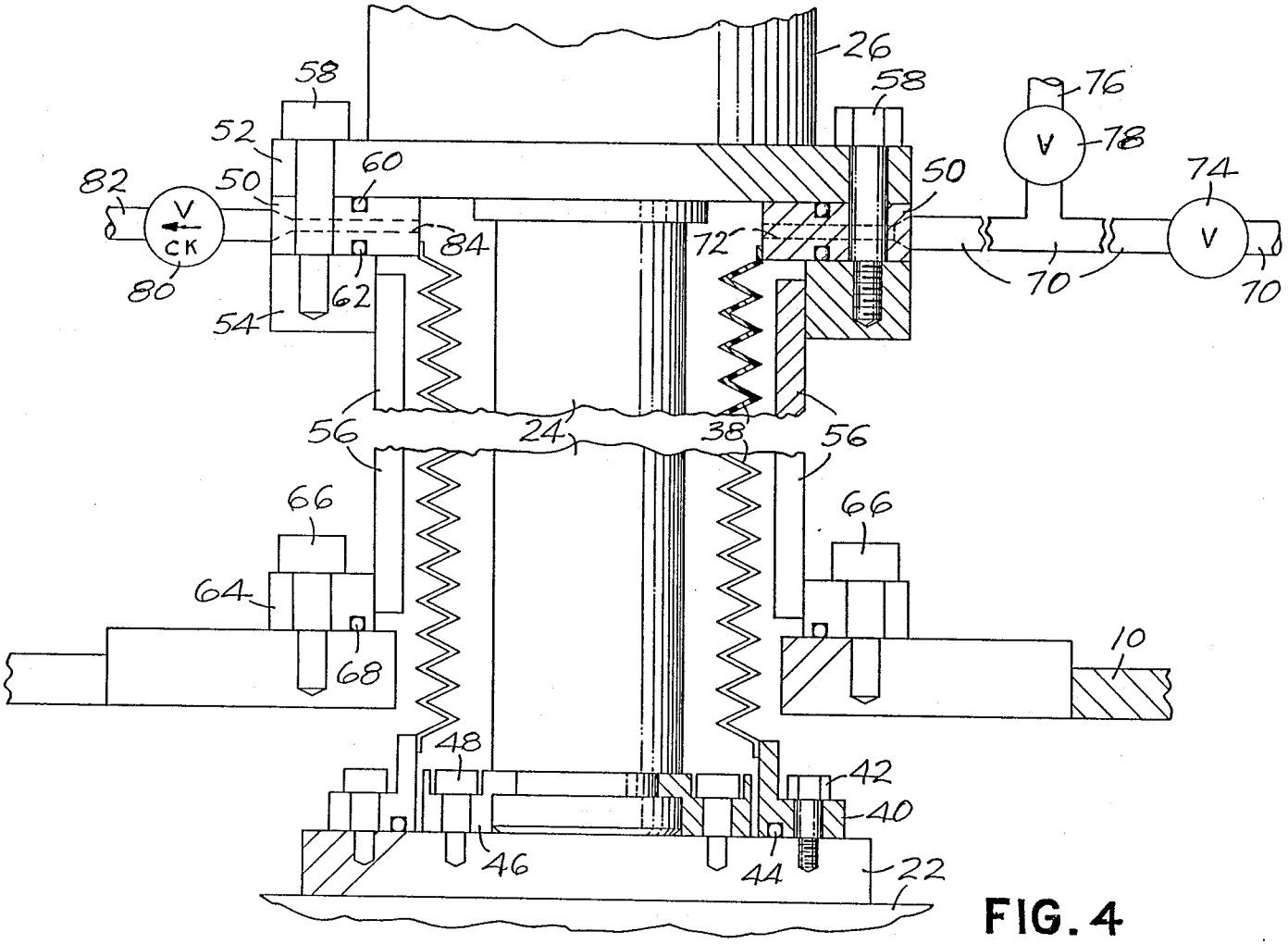
FIG. 4 is a fragmentary, foreshortened view in vertical elevation of a modification of the embodiment of FIG. 3.

FIG. 4 illustrates a modification of the embodiment shown in FIG. 3 to accommodate equalization of pressure on both sides of the flexible or elastic sleeve 38 to protect the latter against rupture or other damage.

As in FIG. 3, the sleeve 38 surrounds the piston rod 24 and is sealed at its lower inner end to the header 22 and hence to the inner end of the piston rod. This is achieved in FIG. 4 by the annular collar 40 secured to the header 22 by bolts 42 and sealed by O-ring seal 44. The bottom end of the piston rod is connected to the header 22 by split ring sections 46 and bolts 48.

The upper, outer end of the sleeve is sealed to an annular collar 50 which is interposed between the bottom flange 52 of the hydraulic cylinder 26 and an annular flange 54 on the upper end of a spacer tube 56. Bolts 58 secure these flanges and collar together, and O-ring seals 60 and 62 ensure a pressure tight seal between them.

The bottom end of the tube 56 is provided with an annular flange 64 which is secured to the top wall of the freeze dryer housing 10 by bolts 66. A pressure tight seal is provided by O-ring seal 68.

The upper end of the sleeve 38 thus is operatively sealed to the inner surface of the freeze dryer chamber 12, as in FIG. 3.

The interior of the hollow sleeve or bellows 38 communicates with a source of vacuum, preferably the same source coupled to inlet 14 (FIG. 1). As illustrated, the communication is provided by an inlet conduit 70 which is connected to the collar 50 and registers with a bore 72 that extends radially inward through the collar and communicates with the interior of the sleeve 38. A control valve 74 in the conduit 70 serves to control communication with the source of vacuum.

Means preferably is provided for testing the sleeve 38 and chamber 12 for vacuum leakage and hence the capability of the system for maintaining pressure. Thus, an air or other gas pressure source is coupled to the conduit 70 between the valve 74 and the collar 70, as by means of conduit 76 and associated control valve 78.

The leak testing is accomplished by backfilling air or other gas under pressure through the control valve 78 into the interior of the bellows 38 and performing a rate-of-rise pressure test on the atmosphere within the chamber 12 to ascertain whether leakage through the bellows is beyond acceptable limits. This test thus eliminates a potential source of non-sterile contamination from entering the freeze dryer chamber 12 from the piston rod 24.

FIG. 4 also illustrates an alternative to the coupling of a source of vacuum to the interior of the bellows or sleeve 38. Thus, a check valve 80 communicates the interior of the bellows with the atmosphere through conduits 82 and radial bore 84 in the collar 50, and operates to allow air in the interior space of the bellows to be exhausted to the atmosphere but to prevent air from being drawn from the atmosphere into the interior space of the bellows.

Thus, when the bellows is collapsed during retraction of the piston rod 24 from the chamber 12 and into the hydraulic cylinder 26, air is expelled from the interior of the bellows. Accordingly, as the bellows is extended during extension of the piston rod from the hydraulic cylinder and into the chamber 12, the pressure within the interior of the bellows is reduced.

It has been determined that a single collapsing and extension of the bellows reduces the pressure within the interior of the bellows from normal atmospheric pressure to about 2.8 pounds per square inch. This reduction is quite sufficient for many functions. However, further pressure reduction may be achieved by repeating the collapsing and extension of the bellows.

It will be apparent to those skilled in the art that various changes may be made in the structural details described hereinbefore, without departing from the spirit of this invention and the scope of the appended claims.

Having now described my invention and the manner in which it may be used, I claim:

1. In a freeze dryer in which an external elongated hydraulic cylinder has an elongated piston rod extending therefrom through a wall of the freeze dryer for longitudinal reciprocation within a freeze dryer chamber for moving a plurality of vertically separated shelves toward and away from each other, the method of preventing possible contamination of the freeze dryer chamber by the piston rod, comprising isolating the piston rod from the interior of the freeze dryer chamber by enclosing the piston rod within the freeze dryer chamber with an impervious sleeve capable of extending and retracting with the piston rod through the full range of movement of the shelves.

2. In combination with a freeze dryer having an elongated hydraulic cylinder located externally of the freeze dryer with its elongated piston rod extending through a wall of the freeze dryer for longitudinal reciprocation within the freeze dryer chamber for moving a plurality of vertically separated shelves toward and away from each other, means for preventing possible contamination of the freeze dryer chamber by the piston rod, comprising an impervious flexible sleeve surrounding the piston rod within the freeze dryer chamber and sealed at one end to the inner surface of the chamber and at the opposite end to the inner end of the piston rod, the sleeve being capable of extending and retracting with the piston rod through the full range of movement of the shelves.

3. In a freeze dryer in which an external elongated hydraulic cylinder has an elongated piston rod extending therefrom through a wall of the freeze dryer for longitudinal reciprocation within a freeze dryer chamber for moving a plurality of vertically separated shelves toward and away from each other, the method of preventing possible contamination of the freeze dryer chamber by the piston rod, comprising isolating the piston rod from the interior of the freeze dryer chamber by enclosing the piston rod within the freeze dryer chamber with an impervious sleeve capable of extending and retracting with the piston rod, and maintaining the interior of the impervious sleeve at substantially the same pressure as the freeze dryer chamber.

4. In a freeze dryer in which an external elongated hydraulic cylinder has an elongated piston rod extending therefrom through a wall of the freeze dryer for longitudinal reciprocation within a freeze dryer chamber for moving a plurality of vertically separated shelves toward and away from each other, the method of preventing possible contamination of the freeze dryer chamber by the piston rod, comprising isolating the piston rod from the interior of the freeze dryer chamber by enclosing the piston rod within the freeze dryer chamber with an impervious sleeve capable of extending and retracting with the piston rod, and exhausting air from the interior of the sleeve by collapsing the sleeve as the piston rod is retracted from the freeze dryer chamber, and preventing air from entering the interior of the sleeve as the sleeve and piston rod are extended into the freeze dryer chamber.

5. In combination with a freeze dryer having an elongated hydraulic cylinder located externally of the freeze dryer with its elongated piston rod extending through a wall of the freeze dryer for longitudinal reciprocation within thefreeze dryer chamber for moving a plurality of vertically separated shelves toward and away from each other, means for preventing possible contamination of the freeze dryer chamber by the piston rod, comprising enclosure means surrounding the piston rod and operable to prevent possible contamination of the piston rod by the hydraulic cylinder from entering the freeze dryer chamber, the enclosure means comprising an impervious flexible sleeve surrounding the piston rod within the freeze dryer chamber and sealed at one end to the inner surface of the chamber and at the opposite end to the inner end of the piston rod, means for communicating the interior of the freeze dryer chamber with a source of vacuum or inert gas, and means for communicating the interior of the impervious sleeve with a source of vacuum or inert gas for maintaining the interior of the sleeve at substantially the same pressure as the freeze dryer chamber.

6. The combination of claim 5 including means for communicating the interior of the sleeve with a source of gas under pressure for periodically testing the sleeve for leakage of gas pressure from the interior of the sleeve into the freeze dryer chamber.

7. In combination with a freeze dryer having an elongated hydraulic cylinder located externally of the freeze dryer with its elongated piston rod extending through a wall of the freeze dryer for longitudinal reciprocation within thefreeze dryer chamber for moving a plurality of vertically separated shelves toward and away from each other, means for preventing possible contamination of the freeze dryer chamber by the piston rod, comprising enclosure means surrounding the piston rod and operable to prevent possible contamination of the piston rod by the hydraulic cylinder from entering the freeze dryer chamber, the enclosure means comprising an impervious flexible sleeve surrounding the piston rod within the freeze dryer chamber and sealed at one end to the inner surface of the chamber and at the opposite end to the inner end of the piston rod, and check valve means for communicating the interior of the impervious sleeve with the atmosphere during retraction of the piston rod into the hydraulic cylinder and collapsing of the sleeve and for sealing the interior of the sleeve from the atmosphere during extension of the piston rod into the freeze dryer chamber and extension of the sleeve.

* * * * *